US010543522B2

(12) United States Patent
Etzel et al.

(10) Patent No.: US 10,543,522 B2
(45) Date of Patent: Jan. 28, 2020

(54) PROCESSING UNIT AND MACHINE TOOL FOR THE PUNCHING PROCESSING OF WORKPIECES

(71) Applicant: TRUMPF Werkzeugmaschinen GmbH + Co. KG, Ditzingen (DE)

(72) Inventors: Kai Etzel, Besignheim (DE); Dennis Traenklein, Nufringen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 243 days.

(21) Appl. No.: 15/460,841

(22) Filed: Mar. 16, 2017

(65) Prior Publication Data

US 2017/0266714 A1 Sep. 21, 2017

(30) Foreign Application Priority Data

Mar. 17, 2016 (EP) ..... 16160858

(51) Int. Cl.
*B21D 45/00* (2006.01)
*B21D 28/02* (2006.01)
*B30B 1/40* (2006.01)

(52) U.S. Cl.
CPC ..... *B21D 45/006* (2013.01); *B21D 28/02* (2013.01); *B30B 1/40* (2013.01)

(58) Field of Classification Search
CPC .... B21D 45/00; B21D 45/003; B21D 45/006; B21D 45/06; B21D 45/08; B21D 45/10;
(Continued)

(56) References Cited

U.S. PATENT DOCUMENTS 3,209,631 A * 10/1965 Buczkowske ..... B21D 45/00 83/131
3,225,636 A 12/1965 Schott et al.
(Continued)

FOREIGN PATENT DOCUMENTS

CN 102814426 12/2012
CN 104070123 10/2014
(Continued)

OTHER PUBLICATIONS

Office Action in Chinese Application No. 2017103036456, dated Aug. 1, 2018, 6 pages (with English Translation).

*Primary Examiner* — Evan H Macfarlane
(74) *Attorney, Agent, or Firm* — Fish & Richardson P.C.

(57) ABSTRACT

A processing unit of a machine tool for the punching processing of workpieces, in particular metal sheets, has a punching tool carrier configured to receive a punching tool and a stripper carrier for a stripper. The punching tool carrier can be moved by a punch drive along a stroke axis by a transverse drive element being driven by a punch drive motor relative to the punching tool carrier with a transverse drive movement along a transverse movement axis which extends in the transverse direction of the stroke axis. The stripper carrier can be moved along the stroke axis by a stripper drive, and the transverse drive element of the punch drive during the transverse drive movement can be moved relative to the stripper carrier along the transverse movement axis and the punching tool carrier and the stripper carrier can be moved relative to each other along the stroke axis.

14 Claims, 2 Drawing Sheets

(58) Field of Classification Search
CPC ..... B21D 28/02; B21D 28/26; B21D 28/265; B21D 28/002; B30B 1/40; B26F 1/02; B26F 1/14; B26F 1/38; B26F 1/40; B26F 1/405
See application file for complete search history.

(56) References Cited

U.S. PATENT DOCUMENTS

| | | | | | |
|---|---|---|---|---|---|
| 3,295,351 | A * | 1/1967 | Jacobs | B21C 35/02 | 72/344 |
| 3,623,389 | A * | 11/1971 | Krynytzky et al. | B21D 24/14 | 83/617 |
| 4,283,932 | A * | 8/1981 | Putetti | B21D 45/06 | 72/345 |
| 5,253,559 | A * | 10/1993 | Philippe | H05K 3/005 | 83/133 |
| 2014/0090443 | A1* | 4/2014 | Schmauder | B21D 28/002 | 72/452.9 |
| 2016/0144419 | A1* | 5/2016 | Traenklein | B21D 28/002 | 72/452.9 |

FOREIGN PATENT DOCUMENTS

| | | | |
|---|---|---|---|
| EP | 2669024 | A1 | 12/2013 |
| EP | 2527058 | B1 | 7/2014 |
| JP | H0737428 | U | 7/1995 |

* cited by examiner

PROCESSING UNIT AND MACHINE TOOL FOR THE PUNCHING PROCESSING OF WORKPIECES

CROSS REFERENCE TO RELATED APPLICATION

This application claims priority under 35 U.S.C. § 119(a) to European Application No. 16 160 858.3, filed on Mar. 17, 2016, the entire contents of which are hereby incorporated by reference.

TECHNICAL FIELD

The invention relates to processing units of machine tools for the punching processing of workpieces, in particular metal sheets.

BACKGROUND

Generic prior art is known from EP 2 527 058 A1. This document discloses a press having a stroke drive device by which a pressing tool can be moved along a stroke axis in the direction towards a workpiece intended to be processed by the pressing tool and/or in the opposite direction. To produce the movement of the pressing tool along the stroke axis, the stroke drive device includes a drive motor and a wedge gear mechanism arranged between the drive motor and the pressing tool. Drive-side wedge gear elements are moved by the drive motor in the transverse direction of the stroke axis of the pressing tool. During their movement, the drive-side wedge gear elements cooperate with output-side wedge gear elements to which the pressing tool is connected and which, as a result of the movements which are carried out in the transverse direction of the stroke axis by the drive-side wedge gear elements, move together with the pressing tool along the stroke axis.

SUMMARY

The present disclosure provides processing units that have a punching tool carrier, to which a punching tool can be fitted, and a punch drive that has a transverse drive element. The punching tool carrier can be moved along a stroke axis by the transverse drive element which can be driven by a punch drive motor of the punch drive relative to the punching tool carrier with a transverse drive movement along a transverse movement axis that extends in the transverse direction of the stroke axis of the punching tool carrier.

In addition to a punching unit having a punching tool carrier for a punching tool and having a punch drive for moving the punching tool carrier and the punching tool along a stroke axis, the processing unit includes a stripper unit with a stripper for the punching tool of the punching unit, wherein the stripper carrier and consequently also the stripper can be positioned along the stroke axis in a state decoupled from the punching tool. The punch drive includes a transverse drive element driven with transverse drive movements along a transverse movement axis extending in the transverse direction of the stroke axis to produce movements of the punching tool carrier along the stroke axis. To decouple the stripper movement from the punching tool movement the transverse drive element of the punch drive can be moved along the transverse movement axis during its transverse drive movements relative to the stripper carrier.

Furthermore, the punching tool carrier and the stripper carrier can be moved relative to each other along the stroke axis. The position of the stripper carrier and consequently also the position of the stripper that is fitted to the stripper carrier along the stroke axis can consequently be defined independently of the position which the punching tool carrier and the punching tool assume along the stroke axis. Movements of the transverse drive element of the punch drive along the transverse movement axis do not influence the position of the stripper carrier and the stripper along the stroke axis.

As a result, it is possible to operate the stripper not only in an "active stripper" operating mode, but also in a "passive stripper" operating mode.

In the "active stripper" operating mode, the stripper does not necessarily need an independent drive to be able to carry out movements along the stroke axis. Instead, positions that the stripper assumes along the stroke axis are defined by the punching tool or by the punching tool carrier provided with the punching tool when the punching tool performs an operating stroke directed along the stroke axis in the direction towards the workpiece and when the punching tool performs a return stroke that is carried out in the opposite direction. When coupled to the punching tool, the stripper moves during the operating stroke of the punching tool along the stroke axis in the direction towards the workpiece until the stripper strikes the workpiece. When the stripper is supported on the workpiece and consequently necessarily cannot change in terms of location in the direction of the stroke axis, the punching tool continues its operating stroke along the stroke axis until the workpiece has been subjected to a punching processing operation. When the dead center of the operating stroke has been reached, the return stroke of the punching tool in the opposite direction to the operating stroke is initiated and the punching tool initially moves relative to the stripper, which continues to be positioned on the workpiece in the opposite direction to the operating stroke along the stroke axis until the punching tool exits the punched workpiece. As soon as the punching tool has left the workpiece, it carries the stripper in the return stroke direction with a movement away from the workpiece.

In the "passive stripper" operating mode, the stripper is moved along the stroke axis into a position in which the stripper is spaced apart from the workpiece. When the stripper is spaced apart from the workpiece, the workpiece is processed using the punching tool that carries out a correspondingly dimensioned stroke relative to the stripper along the stroke axis. In contrast to the above-described "active stripper" operating mode, in the "passive stripper" operating mode the position assumed by the stripper during the workpiece processing operation along the stroke axis is defined by a separate stripper drive, because in contrast to the "active stripper" operating mode, the workpiece cannot be used for this purpose. It is possible to move the stripper and the punching tool along the stroke axis without the assistance of, and decoupled from, the workpiece so that the workpiece processing operation can be carried out by the punching tool when the stripper is spaced apart from the workpiece.

In some embodiments, to enable the transverse drive element of the punch drive to move in an operationally reliable manner relative to the stripper carrier along the transverse movement axis, the stripper carrier in one embodiment of the invention is supported in the direction of the transverse movement axis, wherein to achieve a particularly compact construction of the processing unit, the punching tool carrier is used to support the stripper carrier.

A defined movement of the transverse drive element of the punch drive along the transverse movement axis is ensured by a corresponding guiding of the transverse drive element. To achieve a compact construction of the processing unit, a carrier structure provided for the stripper carrier and on which the stripper carrier is movably supported in the direction of the stroke axis is used to guide the transverse drive element along the transverse movement axis. In the direction of the transverse movement axis, the carrier structure for the stripper carrier can be supported on the punching tool carrier so that the transverse drive element of the punch drive can move in an operationally reliable manner relative to the carrier structure for the stripper carrier along the transverse movement axis.

A compact construction of the entire arrangement is also produced when the transverse drive element of the punch drive is supported on a carrier structure of the processing unit in the direction of the stroke axis and itself supports the stripper carrier and/or the carrier structure thereof and/or a stripper drive motor of the stripper drive and/or the punching tool carrier in the direction of the stroke axis.

In another embodiment, a piston/cylinder motor is provided as the stripper drive motor.

In embodiments, a support of the stripper carrier on the punching tool carrier which support is effective in the direction of the transverse movement axis with simultaneous movability of the stripper carrier along the stroke axis is produced by the stripper carrier being connected to a stripper drive motor of the stripper drive by a drive rod which passes, in particular extends through, the punching tool carrier along the stroke axis, wherein the stripper carrier is arranged at the side of the drive rod remote from the stripper drive motor.

If a piston/cylinder motor is provided as a stripper drive motor, it is possible to use as the drive rod that passes or extends through the punching tool carrier a piston rod fitted to the piston of the stripper drive motor and to the end of which remote from the stripper drive motor the stripper carrier is connected.

To ensure a particularly effective support and guiding of the stripper carrier and consequently also of the stripper, there are used in a further embodiment of the invention two drive rods that are, in particular, offset with respect to each other along the transverse drive axis. Both drive rods pass or extend through the punching tool carrier along the stroke axis. By both drive rods, the stripper carrier is supported in the direction of the transverse movement axis and movably guided on the punching tool carrier along the stroke axis.

In this instance, there is used to move the drive rods that are provided with the stripper carrier a stripper drive motor having two motor units, each of which is associated with one of the two drive rods. In another embodiment of the invention, the motor units of the stripper drive motor are constructed as piston/cylinder units.

There is provided as the punch drive in particular a drive construction that has a wedge gear mechanism arranged between the punch drive motor and the punching tool carrier. The wedge gear mechanism includes one or two punch-drive-motor-side gear elements that are each formed by a transverse drive element of the punch drive. One or two punching-tool-carrier-side gear elements of the wedge gear mechanism are associated with the gear element(s) that is/are at the punch drive motor side.

If two transverse drive elements are provided as punch-drive-motor-side gear elements, the transverse drive elements are moved in opposite directions along the transverse movement axis to produce movements of the punching tool carrier along the stroke axis.

The transverse drive element(s) and/or the punching-tool-carrier-side gear element(s) of the punch drive is/are in an advantageous embodiment of the invention constructed as gear wedge(s) having a wedge face that is inclined with respect to the transverse movement axis.

In some embodiments of the machine tool, there is provision for the entire processing unit to be able to be positioned on a machine frame of the machine tool along the transverse movement axis. With positioning movements carried out along the transverse movement axis, the processing unit approaches the processing sites on the workpiece. In this instance, a workpiece and the processing unit of the machine tool can preferably be positioned relative to each other in a plane that extends perpendicularly to the stroke axis and that is defined by the transverse movement axis and by another axis that extends perpendicularly to the transverse movement axis. To produce the relative movement of the processing unit and the workpiece in the direction of the additional movement axis, a corresponding movability of the workpiece or a corresponding movability of the processing unit or a corresponding movability of both the workpiece and the processing unit are conceivable.

In some embodiments of the invention, the movements of the processing unit along the transverse movement axis are produced by the punch drive motor driving the transverse drive element(s) along the transverse movement axis and the transverse drive elements carrying the punching tool carrier and the stripper carrier in the movement direction.

The invention is explained in greater detail below with reference to exemplary schematic illustrations, in which:

DETAILED DESCRIPTION

Figure 1:
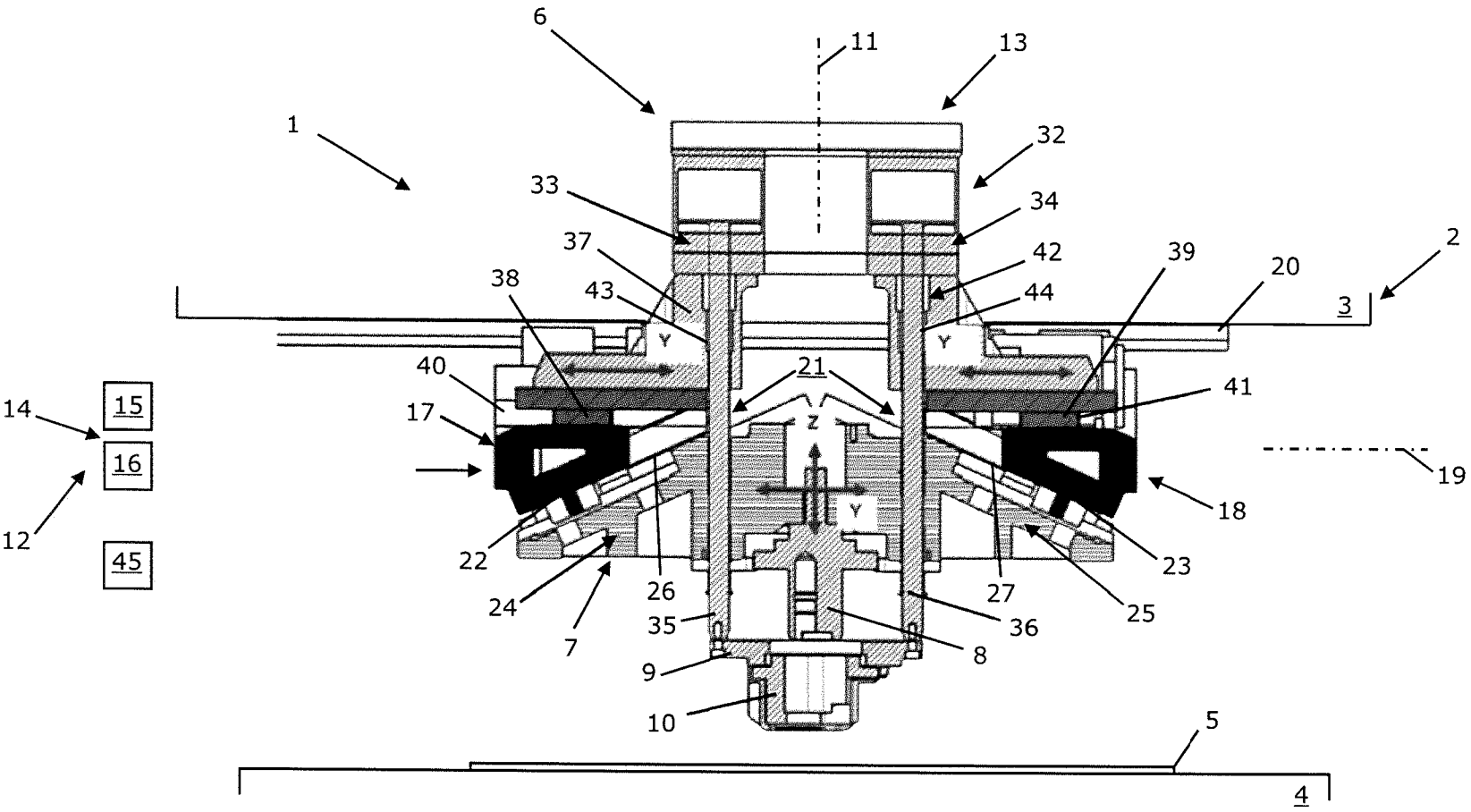
FIG. 1 is a schematic illustration of a machine tool having a processing unit for the punching processing of metal sheets.

Referring to FIG. 1, a machine tool which is constructed as a punching machine 1 has a machine frame 2 with an upper horizontal frame leg 3. The upper frame leg 3 extends over a workpiece support 4 which supports a workpiece, typically a metal sheet 5.

The punching processing operation of the metal sheet 5 is carried out by a processing unit 6. The processing unit 6 includes a punching tool carrier 7 having a conventional tool receiving member 8 in which a punching tool in the form of a punching die of conventional construction (not illustrated in FIG. 1) can be introduced or received by the tool receiving member 8. Furthermore, the processing unit 6 includes an annular stripper carrier 9, which supports a stripper 10 of conventional construction for the punching die that is introduced in the tool receiving member 6.

The punching tool carrier 7 with the tool receiving member 8 and the punching die that has been introduced in the tool receiving member 8, on the one hand, and the stripper carrier 9 with the stripper 10, on the other hand, can be moved and positioned along a vertical stroke axis 11 (Z axis) in a state decoupled from each other. The movements of the punching tool carrier 7 along the stroke axis 11 are produced by a motorized punch drive 12. A motorized stripper drive 13 moves and positions the stripper carrier 9 along the stroke axis 11.

Figure 2:
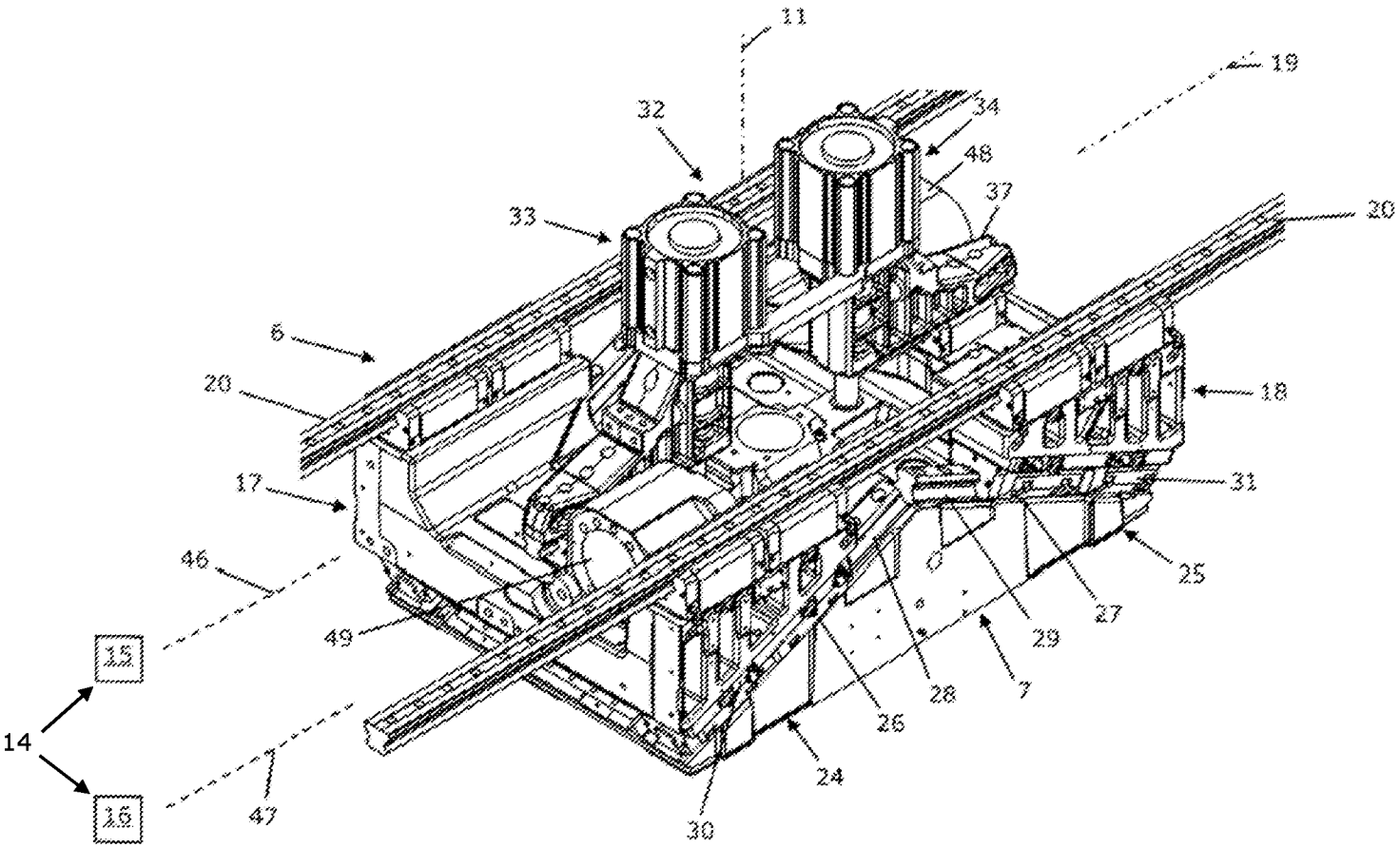
FIG. 2 is a detailed perspective illustration of the processing unit according to FIG. 1.

Referring to FIG. 2, the punch drive 12 includes an electric punch drive motor 14 with two motor units 15, 16 mounted on the machine frame 2. The motor unit 15 drives a first transverse drive element 17 via a drive spindle 46 which is indicated with broken lines in FIG. 2 and the motor unit 16 drives a second transverse drive element 18 via a drive spindle 47 which is also indicated with broken lines along a horizontal transverse movement axis 19 (Y axis). The drive spindles 46, 47 of the motor units 15, 16 engage with spindle nuts 48, 49 which are fitted to the first transverse drive element 17 and to the second transverse drive element 18, respectively.

The drive spindles 46, 47 have threads that extend in the same direction. With rotation in the same direction the drive spindles 46, 47 consequently drive the spindle nuts 48, 49 and the transverse drive elements 17, 18 that are connected thereto along the transverse movement axis 19 in the same direction. Mutually opposing rotation movements of the drive spindles 46, 47 bring about opposing movements of the spindle nuts 48, 49 and the transverse drive elements 17, 18 along the transverse movement axis 19.

During their movements along the transverse movement axis 19, the first transverse drive element 17 and the second transverse drive element 18 are guided in their movement direction on guide rails 20 of the processing unit 6 which are common to the transverse drive elements 17, 18. The guide rails 20 are fitted to the machine frame 2 of the punching machine 1, which frame is not illustrated in FIG. 2 for the sake of clarity, and consequently form a carrier structure of the processing unit 6.

Referring back to FIG. 1 as well, the first transverse drive element 17 and the second transverse drive element 18 are part of a wedge gear mechanism 21 which is between the punch drive motor 14 or the motor units 15, 16, on the one hand and the punching tool carrier 7 on the other hand. The first transverse drive element 17 and the second transverse drive element 18 form punch-drive-motor-side gear elements of the wedge gear mechanism 21 and are gear wedges.

On wedge faces 22, 23, which are inclined in opposite directions with respect to the transverse movement axis 19, the transverse drive elements 17, 18 cooperate with gear wedges 24, 25 of the punching tool carrier 7. The gear wedges 24, 25 form punching-tool-carrier-side gear elements of the wedge gear mechanism 21 and have wedge faces 26, 27, which extend in opposing directions with respect to the transverse movement axis 19 and which face the wedge faces 22, 23 of the first transverse drive element 17 and the second transverse drive element 18, respectively.

Fitted to the wedge faces 26, 27 of the gear wedges 24, 25 are guide rails 28, 29 on which are positioned guide shoes 30, 31, which are mounted on the first transverse drive element 17 and the second transverse drive element 18, respectively. As a result of a positive-locking connection which is effective in a vertical direction between the guide rails 28, 29 and the guide shoes 30, 31, the punching tool carrier 7 is suspended on the first transverse drive element 17 and the second transverse drive element 18. The transverse drive elements 17, 18 are in turn supported via the guide rails 20 on the machine frame 2 of the punching machine 1 in a vertical direction and consequently along the stroke axis 11. The first transverse drive element 17 and the second transverse drive element 18 can be moved relative to the punching tool carrier 7 along the transverse movement axis 19.

In FIG. 1, the first transverse drive element 17 and the second transverse drive element 18 are spaced apart from each other to the maximum extent along the transverse movement axis 19. The punching tool carrier 7 is therefore raised to the maximum extent along the stroke axis 11 with respect to the workpiece support 4 and the metal sheet 5 which is supported thereon.

If, starting from these relationships, the motor units 15, 16 of the punch drive motor 14 are actuated with corresponding opposed rotation directions of the drive spindles 46, 47, the transverse drive elements 17, 18 which are driven by the motor units 15, 16, move towards each other along the transverse movement axis 19. As a result of the horizontal forced guiding of the transverse drive elements 17, 18, the wedge gear mechanism 21, as a result of the first transverse drive element 17 and the second transverse drive element 18 moving closer together, causes the punching tool carrier 7 to be lowered along the stroke axis 11 with an operating stroke towards the workpiece support 4 and the metal sheet 5.

The lowering movement of the punching tool carrier 7 along the stroke axis 11 carried out to process the metal sheet 5 ends as soon as the punching die which is mounted on the tool receiving member 8 of the punching tool carrier 7 has pierced the metal sheet 5 and has thereby processed it in a punching manner. During the punching processing of the metal sheet 5, the punching die cooperates with a bottom punching die of conventional construction type which is on the lower side of the metal sheet 5 and which cannot be seen in the drawings.

When the operating stroke has ended, the motor units 15, 16 and the drive spindles 46, 47 are controlled to change their rotation directions and the first transverse drive element 17 and the second transverse drive element 18 are moved apart from each other by the motor units 15, 16 with mutually opposing movements along the transverse movement axis 19. Consequently, the punching tool carrier 7 is lifted with a reverse stroke along the stroke axis 11 until it finally again assumes the position illustrated in FIG. 1.

To move the entire processing unit 6 along the upper frame leg 3 of the machine frame 2 to another processing site, the motor units 15, 16 and the drive spindles 46, 47 are actuated with the same rotation direction. Depending on the direction of the rotational movement of the drive spindles 46, 47 in the same direction, the transverse drive elements 17, 18 and with them the entire processing unit 6 move starting from the position of FIG. 1 along the transverse movement axis 19 to the right or to the left in FIG. 1.

In a state decoupled from the punching tool carrier 7, the stripper carrier 9 and the stripper 10 are moved along the stroke axis 11 by a stripper drive motor 32 of the stripper drive 13. The stripper drive motor 32 includes two motor units in the form of piston/cylinder units 33, 34.

The stripper carrier 9 is connected to the piston/cylinder unit 33 by a first drive rod 35. A second drive rod 36 connects the stripper carrier 9 to the piston/cylinder unit 34. In this instance, the drive rods 35, 36 are piston rods of the piston/cylinder units 33, 34.

The first drive rod 35 and the second drive rod 36 are offset with respect to each other along the transverse movement axis 19. Both the first drive rod 35 and the second drive rod 36 extend through the punching tool carrier 7 along the stroke axis 11. The stripper carrier 9 is supported on the punching tool carrier 7 via the drive rods 35, 36 in the direction of the transverse movement axis 19 and movably guided along the stroke axis 11.

The first transverse drive element 17 and the second transverse drive element 18 can be moved relative to the stripper carrier 9 along the transverse movement axis 19. The movements carried out by the transverse drive elements 17, 18 relative to the stripper carrier 9 along the transverse movement axis 19 are guided. To this end, guiding shoes 38, 39 are arranged on a support 37, which is provided for the piston/cylinder units 33, 34 and which forms a carrier structure. Guide rails 40, 41 are arranged at the upper side of the transverse drive elements 17, 18. To guide the transverse drive elements 17, 18 relative to the stripper carrier 9 along the transverse movement axis 19, the guiding shoes 38, 39 on the support 37 of the piston/cylinder units 33, 34 cooperate with the guide rails 40, 41 on the transverse drive elements 17, 18.

At the same time, the transverse drive elements 17, 18 take over the support of the stripper carrier 9 and the support 37 and the support of the stripper drive motor 32 and the drive rods 35, 36 in the direction of the stroke axis 11.

In FIG. 1 the stripper 10 which is mounted on the stripper carrier 9 is in a position in which the stripper 10 is slightly spaced apart from the upper side of the metal sheet 5 along the stroke axis 11. The stripper carrier 9 and the stripper 10 are retained by a clamping device 42. In this position along the stroke axis 11. The clamping device 42 is connected to the support 37 for the piston/cylinder units 33, 34 and includes switchable clamping units 43, 44. In a corresponding switching state, the clamping unit 43 secures the first drive rod 35 along the stroke axis 11. Accordingly, the clamping unit 44 serves to secure the second drive rod 36 along the stroke axis 11. With the drive rods 35, 36 clamped the stripper 10 is in the "passive stripper" operating mode. In this operating mode, the stripper 10 maintains the distance defined by the clamping device 42 from the metal sheet 5 regardless of the current position of the punching tool carrier 7 and the punching tool which is fitted thereto.

A numerical machine control 45 which is illustrated schematically in FIG. 1 controls the punch drive 12 and the stripper drive 13. The numerical machine control 45 also takes over the control of the other functions of the machine tool 1, inter alia the above-described displacement movements of the entire processing unit 6 along the transverse movement axis 19.

Other Embodiments

The details of one or more embodiments of the invention are set forth in the accompanying drawings and the description below. Other features, objects, and advantages of the invention will be apparent from the description and drawings, and from the claims.

A number of embodiments of the invention have been described. Nevertheless, it will be understood that various modifications may be made without departing from the spirit and scope of the invention. Accordingly, other embodiments are within the scope of the following claims.

What is claimed is:

1. A processing unit of a machine tool for punching processing of workpieces comprising:

a first carrier structure;

a punching tool carrier configured to receive a punching tool;

a punch drive that has a first transverse drive element and a second transverse drive element, the first and the second transverse drive elements of the punch drive being configured to move the punching tool carrier along a stroke axis, wherein the punch drive comprises a punch drive motor configured to move the first and the second transverse drive elements of the punch drive in opposite directions relative to the punching tool carrier, the first and the second transverse drive elements of the punch drive thus performing a transverse drive movement along a transverse movement axis, the transverse movement axis being an axis that extends in a transverse direction of the stroke axis, wherein each of the first and the second transverse drive elements of the punch drive forms a punch-drive-motor-side gear element, wherein a wedge gear mechanism includes the punch-drive-motor-side gear elements, the wedge gear mechanism being between the punch drive motor and the punching tool carrier, and wherein with the punching tool carrier being driven along the stroke axis, the first transverse drive element of the punch drive cooperates with a first punching-tool-carrier-side gear element of the wedge gear mechanism and the second transverse drive element of the punch drive cooperates with a second punching-tool-carrier-side gear element of the wedge gear mechanism;

a stripper carrier configured to hold a stripper for the punching tool received by the punching tool carrier, wherein the punching tool carrier and the stripper carrier can be moved relative to each other along the stroke axis; and a stripper drive configured to move the stripper carrier along the stroke axis and comprising a stripper drive motor;

wherein the first and the second transverse drive elements of the punch drive are movable relative to the stripper carrier during the transverse drive movement along the transverse movement axis, wherein the first and the second transverse drive elements of the punch drive are movably guided in a direction of the transverse movement axis relative to the stripper carrier by the first and the second transverse drive elements of the punch drive being guided along the transverse movement axis on a second carrier structure, which second carrier structure is provided for the stripper carrier and for the stripper drive motor and supports the stripper carrier and the stripper drive motor in a direction of the stroke axis, wherein the stripper carrier is movably supported by the second carrier structure for the stripper carrier and for the stripper drive motor in the direction of the stroke axis, wherein the stripper carrier is connected to the stripper drive motor by a drive rod that passes the punching tool carrier along the stroke axis, and wherein the stripper carrier is arranged at a side of the drive rod remote from the stripper drive motor and is supported on the punching tool carrier by the drive rod in the direction of the transverse movement axis and movably guided on the punching tool carrier along the stroke axis, and wherein the first and the second transverse drive elements of the punch drive are supported on the first carrier structure in the direction of the stroke axis and wherein the first and the second transverse drive elements support the second carrier structure for the stripper carrier and for the stripper drive motor in the direction of the stroke axis, wherein the first and the second transverse drive elements of the punch drive support the stripper carrier and the stripper drive motor in the direction of the stroke axis.

2. The processing unit according to claim 1, wherein the stripper carrier is supported on the punching tool carrier in the direction of the transverse movement axis and is movably guided on the punching tool carrier along the stroke axis.

3. The processing unit according to claim 1, wherein each of the first and the second punching-tool-carrier-side gear elements of the wedge gear mechanism is a gear wedge having a wedge face, wherein the wedge faces of the first and the second punching-tool-carrier-side gear elements are inclined in opposite directions with respect to the transverse movement axis.

4. The processing unit according to claim 1, wherein the first and the second transverse drive elements of the punch drive further support the punching tool carrier in the direction of the stroke axis.

5. The processing unit according to claim 1, wherein the stripper drive motor is a piston/cylinder motor.

6. The processing unit according to claim 1, wherein each of the first and the second transverse drive elements of the punch drive as well as each of the first and the second punching-tool-carrier-side gear elements of the wedge gear mechanism is a gear wedge having a wedge face, wherein the wedge faces of the first and the second transverse drive elements of the punch drive are inclined in opposite directions with respect to the transverse movement axis, and wherein the wedge faces of the first and the second punching-tool-carrier-side gear elements of the wedge gear mechanism are inclined in opposite directions with respect to the transverse movement axis.

7. The processing unit according to claim 1, wherein the stripper drive motor is a piston/cylinder motor, wherein the drive rod is a piston rod fitted to a piston of the piston/cylinder motor, and wherein the drive rod has an end remote from the piston/cylinder motor to which end the stripper carrier is connected.

8. The processing unit according to claim 7, wherein the drive rod is a first drive rod and the stripper carrier is further connected to the stripper drive motor of the stripper drive by a second drive rod which is offset with respect to the first drive rod along the transverse movement axis, and which second drive rod passes the punching tool carrier along the stroke axis, wherein the stripper carrier is arranged at a side of the second drive rod remote from the stripper drive motor and is supported on the punching tool carrier by the second drive rod in the direction of the transverse movement axis and movably guided along the stroke axis.

9. The processing unit according to claim 8, wherein the stripper drive motor comprises two motor units and one motor unit of the stripper drive motor is associated with the first drive rod and the other motor unit of the stripper drive motor is associated with the second drive rod.

10. The processing unit according to claim 8, wherein the second drive rod passing the punching tool carrier extends through the punching tool carrier.

11. The processing unit according to claim 1, wherein the drive rod passing the punching tool carrier extends through the punching tool carrier.

12. The processing unit according to claim 1, wherein each of the first and the second transverse drive elements of the punch drive is a gear wedge having a wedge face, wherein the wedge faces of the first and the second transverse drive elements of the punch drive are inclined in opposite directions with respect to the transverse movement axis.

13. A machine tool for punching processing of workpieces, comprising a machine frame configured to support a workpiece, and a processing unit for punching processing of the workpiece, the processing unit comprising:

a first carrier structure;

a punching tool carrier configured to receive a punching tool;

a punch drive that has a first transverse drive element and a second transverse drive element, the first and the second transverse drive elements of the punch drive being configured to move the punching tool carrier along a stroke axis, wherein the punch drive comprises a punch drive motor configured to move the first and the second transverse drive elements of the punch drive in opposite directions relative to the punching tool carrier, the first and the second transverse drive elements of the punch drive thus performing a transverse drive movement along a transverse movement axis, the transverse movement axis being an axis that extends in a transverse direction of the stroke axis, wherein each of the first and the second transverse drive elements of the punch drive forms a punch-drive-motor-side gear element, wherein a wedge gear mechanism includes the punch-drive-motor-side gear elements, the wedge gear mechanism being between the punch drive motor and the punching tool carrier, and wherein with the punching tool carrier being driven along the stroke axis, the first transverse drive element of the punch drive cooperates with a first punching-tool-carrier-side gear element of the wedge gear mechanism and the second transverse drive element of the punch drive cooperates with a second punching-tool-carrier-side gear element of the wedge gear mechanism;

a stripper carrier configured to hold a stripper for the punching tool received by the punching tool carrier, wherein the punching tool carrier and the stripper carrier can be moved relative to each other along the stroke axis; and a stripper drive configured to move the stripper carrier along the stroke axis and comprising a stripper drive motor;

wherein the first and the second transverse drive elements of the punch drive are movable relative to the stripper carrier during the transverse drive movement along the transverse movement axis, wherein the first and the second transverse drive elements of the punch drive are movably guided in a direction of the transverse movement axis relative to the stripper carrier by the first and the second transverse drive elements of the punch drive being guided along the transverse movement axis on a second carrier structure, which second carrier structure is provided for the stripper carrier and for the stripper drive motor and supports the stripper carrier and the stripper drive motor in a direction of the stroke axis, wherein the stripper carrier is movably supported by the second carrier structure for the stripper carrier and for the stripper drive motor in the direction of the stroke axis, wherein the stripper carrier is connected to the stripper drive motor by a drive rod that passes the punching tool carrier along the stroke axis, and wherein the stripper carrier is arranged at a side of the drive rod remote from the stripper drive motor and is supported on the punching tool carrier by the drive rod in the direction of the transverse movement axis and movably guided on the punching tool carrier along the stroke axis, and wherein the first and the second transverse drive elements of the punch drive are supported on the first carrier structure in the direction of the stroke axis and wherein the first and the second transverse drive elements support the second carrier structure for the stripper carrier and for the stripper drive motor in the direction of the stroke axis, wherein the first and the second transverse drive elements of the punch drive support the stripper carrier and the stripper drive motor in the direction of the stroke axis.

14. The machine tool according to claim 13, wherein the processing unit can be positioned on the machine frame along the transverse movement axis.

* * * * *